US006688019B2

(12) United States Patent
Buchweitz

(10) Patent No.: US 6,688,019 B2
(45) Date of Patent: Feb. 10, 2004

(54) BABY BOTTLE DRYER AND ORGANIZER

(76) Inventor: Hope R. Buchweitz, 414 7th Ave. SE., Minot, ND (US) 58701

( * ) Notice: Subject to any disclaimer, the term of this patent is extended or adjusted under 35 U.S.C. 154(b) by 127 days.

(21) Appl. No.: 10/015,004

(22) Filed: Dec. 11, 2001

(65) Prior Publication Data

US 2003/0106237 A1 Jun. 12, 2003

(51) Int. Cl.[7] ..... F26B 25/00

(52) U.S. Cl. ..... 34/106; 34/197; 34/237; 34/239; 219/521

(58) Field of Search ..... 34/69, 184, 187, 34/195, 197, 202, 218, 230, 237, 239, 104, 106, 107; 219/402, 521, 523, 527

(56) References Cited

U.S. PATENT DOCUMENTS 1,742,150 A 12/1929 Rollins
2,039,927 A * 5/1936 Poglein ..... 211/13.1
2,537,439 A 9/1951 Boisblanc
4,708,153 A * 11/1987 Hambleton et al. ..... 134/170
4,748,993 A 6/1988 Llewellyn
4,812,621 A * 3/1989 Brotherton et al. ..... 219/366
D358,243 S 5/1995 Ferguson
5,621,941 A 4/1997 Liu
5,636,400 A 6/1997 Young
D408,106 S 4/1999 Cousins et al.
5,903,944 A 5/1999 Burrell
6,170,107 B1 1/2001 George et al.
6,357,251 B1 * 3/2002 Marks ..... 62/425
6,455,816 B1 * 9/2002 Reddy et al. ..... 219/400

* cited by examiner

*Primary Examiner*—Pamela A Wilson
(74) *Attorney, Agent, or Firm*—Linda D. Wheeler, Esq.; Wheeler Law Offices, P.C.

(57) ABSTRACT

A baby bottle dryer and organizer is herein described. The bottle dryer has hollow posts onto which baby bottles are placed and a blower/fan that blows drying air up into the posts, thus drying the interior of the baby bottles. The bottle dryer further has a removable tray for drying baby bottle nipples and rings/caps into which are from the blower/fan flows. The bottle dryer also has a lid and a front door to protect the baby bottles, nipples, rings/caps from dust and debris.

3 Claims, 4 Drawing Sheets

BABY BOTTLE DRYER AND ORGANIZER

RELATED APPLICATIONS

The present invention is a continuation of Disclosure Document Number 488,446 filed on Feb. 9, 2001.

FIELD OF THE INVENTION

The present invention relates generally to infant and baby products. More specifically, the present invention relates to a baby bottle dryer and organizer.

BACKGROUND OF THE INVENTION

With a baby in the house, it is necessary to keep a plentiful supply of clean, dry baby bottles on hand. Also, in a daycare setting where there are numerous babies/infants to care for, it is even more essential to have plenty of clean, dry, sanitary baby bottles on hand. Given the odd shapes of baby bottles, nipples and caps and rings, it is often difficult and very time consuming to hand dry these pieces. It is essential, however, for the health of the child, that water not be allowed to sit within a bottle, nipple or cap for days on end. Consequently, a need exists for an apparatus into which the bottles, nipples and caps can be inserted and automatically dried. The present invention fulfills this need.

SUMMARY OF THE INVENTION

The present invention, the baby bottle dryer and organizer, is devised to quickly and conveniently dry the entire inside of a baby bottle while also drying the bottles nipple and cap. The baby bottle dryer and organizer consists of a number of angled posts onto which bottles are set for drying and storing. There is also a tray with short vertical posts located along the top of the machine onto which nipples and caps are placed for drying and storage. A fan located on the side of the box circulates air through the posts and up into the bottles and nipples.

It is an object of the present invention to provide a device that automatically dries baby bottles.

It is a further object of the present invention to provide a device that also automatically dries baby bottle nipples and caps.

It is another object of the present invention to provide a device that can be used to organize and store baby bottles, nipples and caps.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
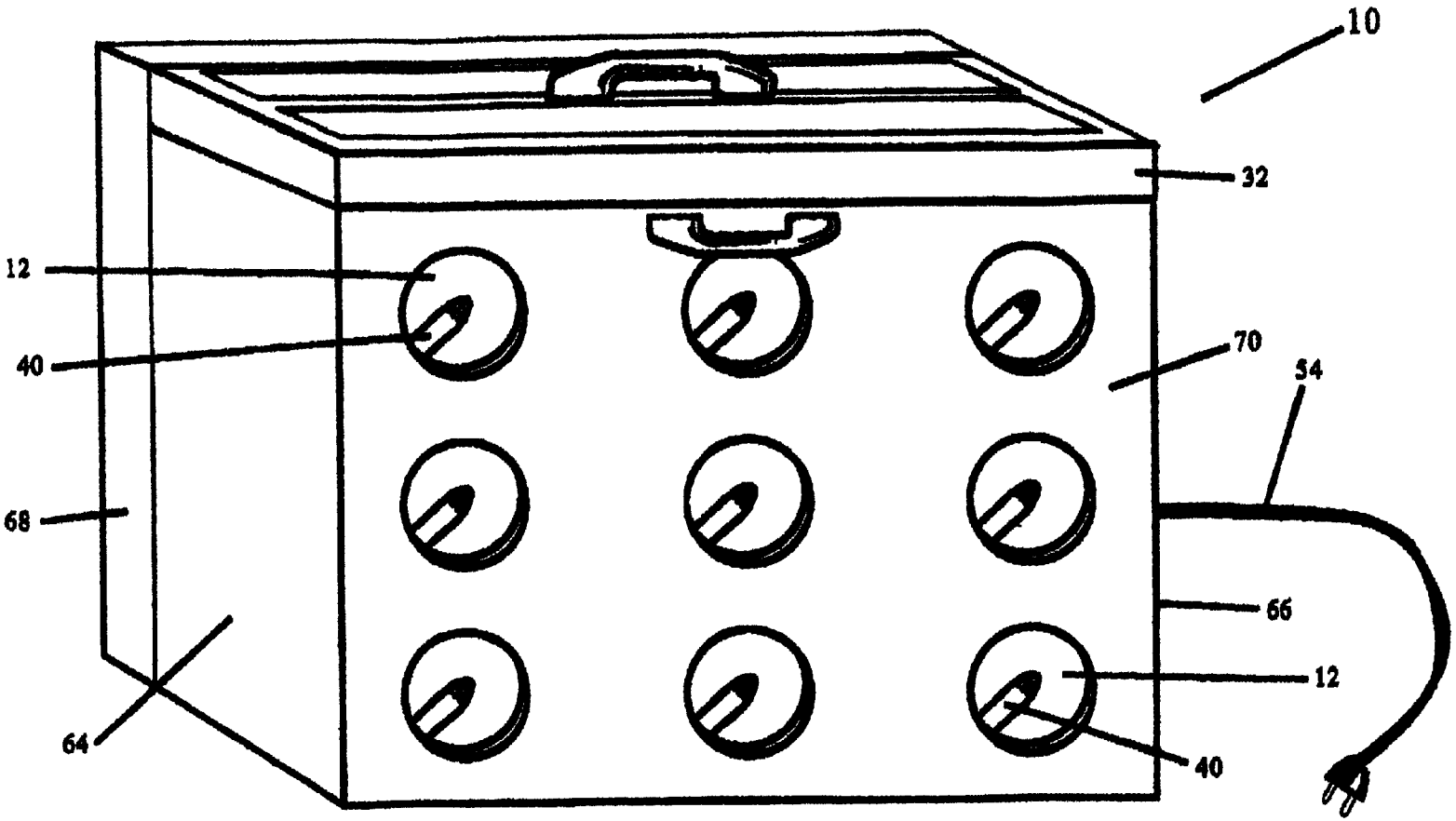
FIG. 1 is a perspective view of the baby bottle dryer and organizer.

The preferred embodiment of the present invention, the baby bottle dryer and organizer 10, is shown in FIG. 1. As can be seen, in the preferred embodiment, the baby bottle dryer and organizer 10 has a front panel 60, a front door 70, a tray 32, a top lid 30, a bottom panel (not shown), a back housing 68, a partition 14, and a left side panel 64, and a right side panel 66. The front panel 60, left side panel 64, right side panel 66, bottom panel (not shown) and partition 14 are all attached to one another at their edges such that an open-topped box is formed. It is preferred that the panels, 60, 64, 66 and partition 14 are each made out of plastic, although one of ordinary skill in the art would recognize that a number of different materials, including wood and metal, could be used to construct the panels 60, 64, 66 and partition 14. The fastening means used to connect the panels 60, 64, 66 and partition 14, therefore depends on the type of material that they are constructed from. In the preferred embodiment, the panels 60, 64, 66 and partition 14 are formed together as one open-topped box. Several openings 12 are cut through the front panel 60 into which baby bottles 20 can be inserted. As mentioned above, the preferred embodiment of the baby bottle dryer and organizer 10, further has a front door 70 that can be opened to access the bottle 20 drying area. The front door 70 exists to keep dirt and dust from settling on the bottles 20. The front door 70 is preferably hinged to the front panel 60. One of ordinary skill in the art would recognize that the front door 70 can be attached in a number of different ways. The number of bottle posts 40 can vary with the overall size of the baby bottle dryer and organizer 10. The baby bottle dryer and organizer also has an electrical cord 54 for supplying power to the device that can be seen in FIG. 1, appearing from an opening cut through the back housing 68.

Figure 2:
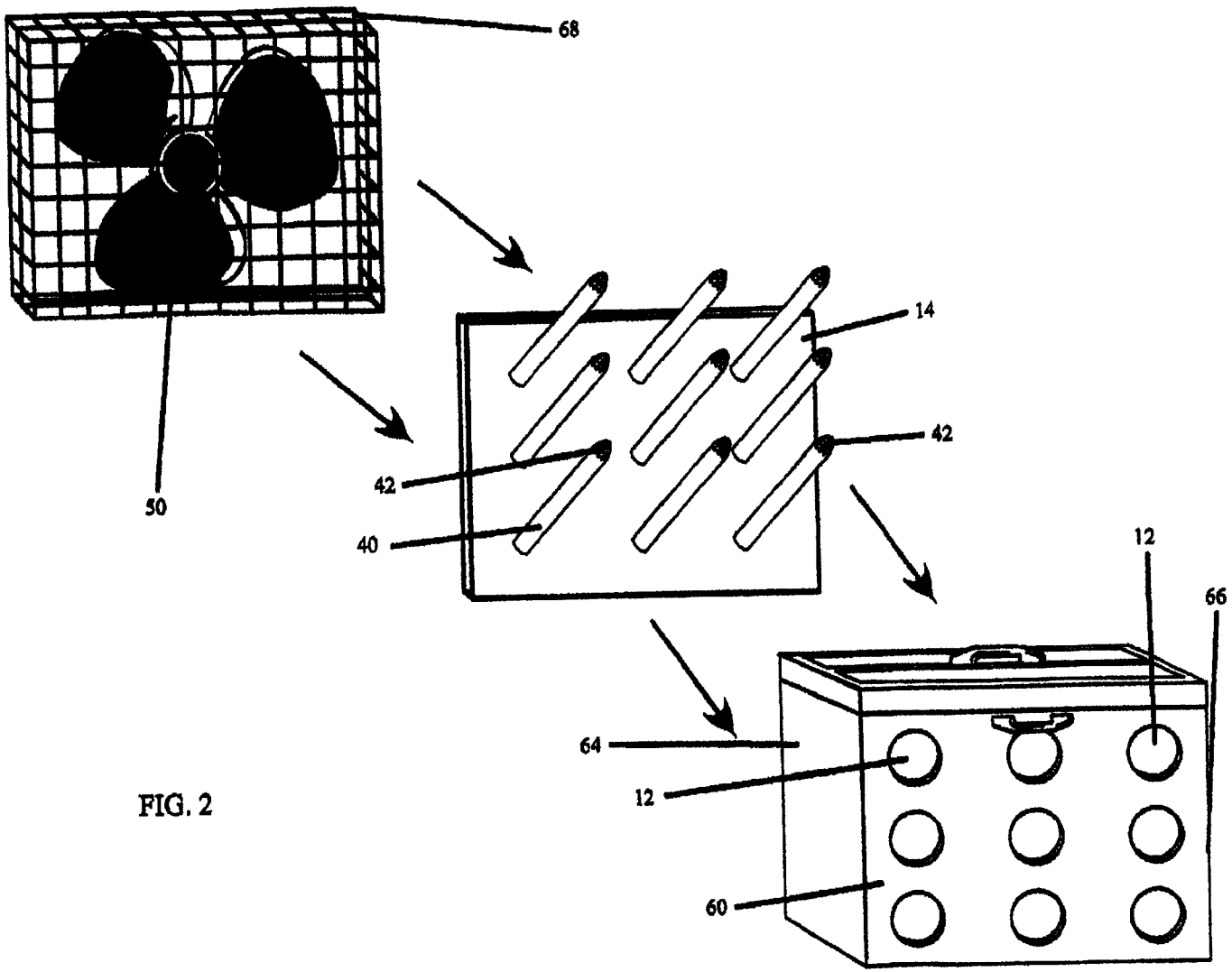
FIG. 2 is an exploded view of the baby bottle dryer and organizer without the top tray and front door.

As shown in FIG. 2, it is preferred that within each opening 12 is a bottle post 40. The number of bottle posts 40 can vary with the size of the baby bottle dryer and organizer. The bottle posts 40 are hollow and have apertures 42 around the top sections thereof allowing for the release of air into the bottles 20 for drying. The number of apertures 42 and placement thereof, can be varied without altering the intent of the invention. In the preferred embodiment, the air is forced up into the bottle posts 40 by a blower/fan 50. In an alternative embodiment, a heating element is added such that the blower/fan 50 forces hot air into the bottle posts 40 and tray 32. It is preferred that the blower/fan 50 is separated from the bottles 20 by an airtight partition 14. The partition 14 has openings only at each point where a bottle post 40 connects to the partition 14 and where the tray 32 meets the partition 14. This ensures that air will only be blown up into the bottle posts 40 and into the tray 32 to dry the baby bottle nipples 22 and the baby bottle rings/caps 24, and not around the outside of the bottles. It is preferred that power to the blower or fan 50 be interrupted or restarted by a power switch or an on/off switch (not shown). One of ordinary skill in the art would readily recognize, however, that a power switch is not necessary. The optional removable tray 32 can also be seen in FIG. 2. The tray 32 has a side aperture into which air from the fan 50 is blown. The tray 32 has nipple posts 44 and ring/cap posts 46 attached or formed into the bottom thereof. The nipple posts 44 are much shorter and thinner that the bottle posts 40. The nipple posts 44 are preferably sized such that a bottle nipple 22 can be placed over the nipple posts 44 and can still come to rest on the tray 32. The ring/cap posts 46 are preferably much shorter than the nipple posts 44 and much wider, sized to fit within a ring/cap 24 without being taller than said ring/cap 24. The tray 32 is preferably removable for purposes of convenience when loading or unloading the baby bottle dryer and organizer 10, but need not be removable. It is preferred that the tray 32 sit on a lip created within the baby bottle dryer and organizer 10.

Figure 3:
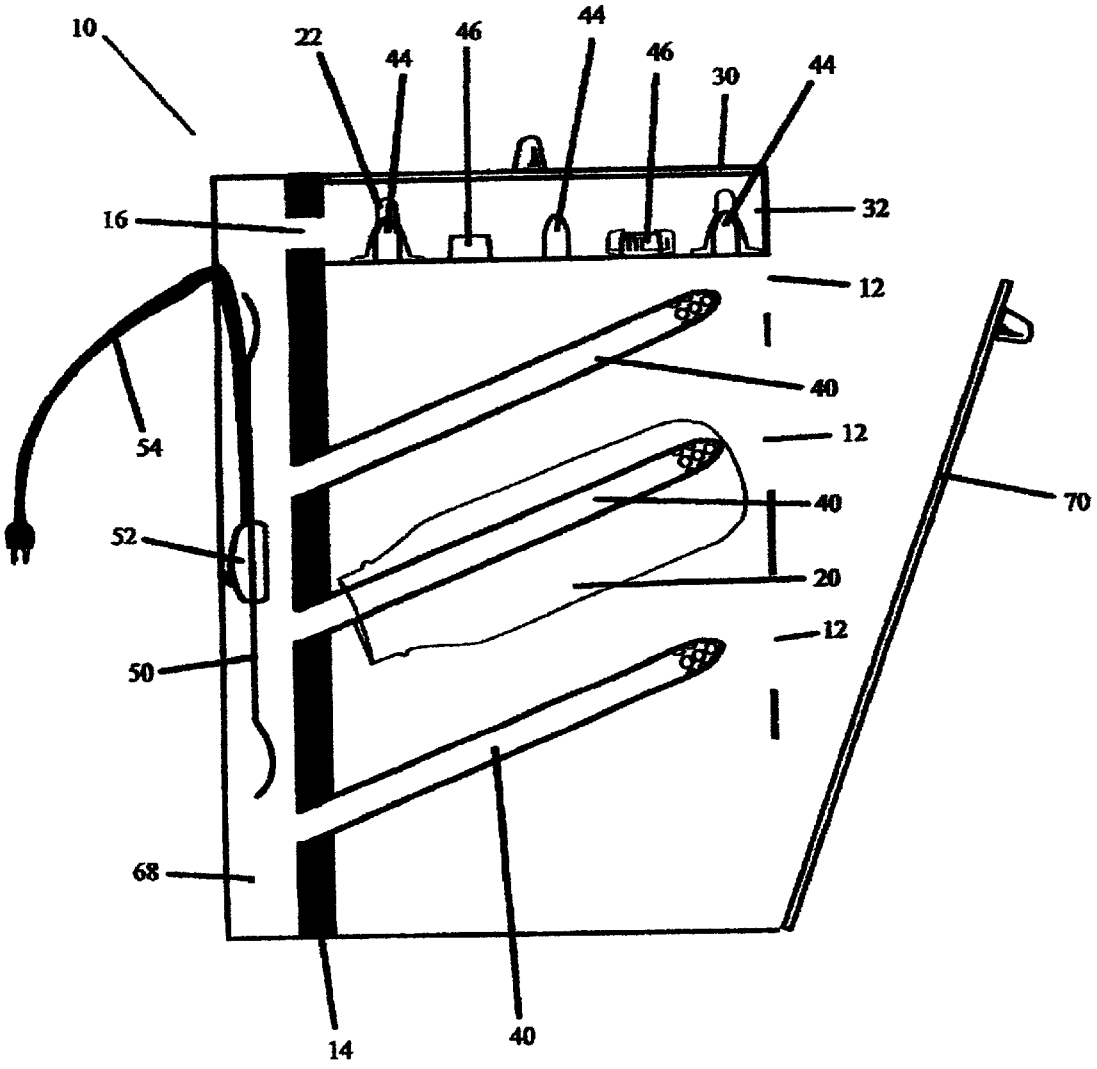
FIG. 3 is a side view of the baby bottle dryer and organizer with the outer side removed to allow illustration of the inner parts.

FIG. 3 illustrates a side view of the preferred embodiment of the baby bottle dryer/organizer with the side panel removed such that a side view of the fan/blower 50 and its motor 52 can be seen. FIG. 3 also illustrates how the bottle posts 40 are preferably angled such that the water runs out of the bottles 20.

Figure 4:
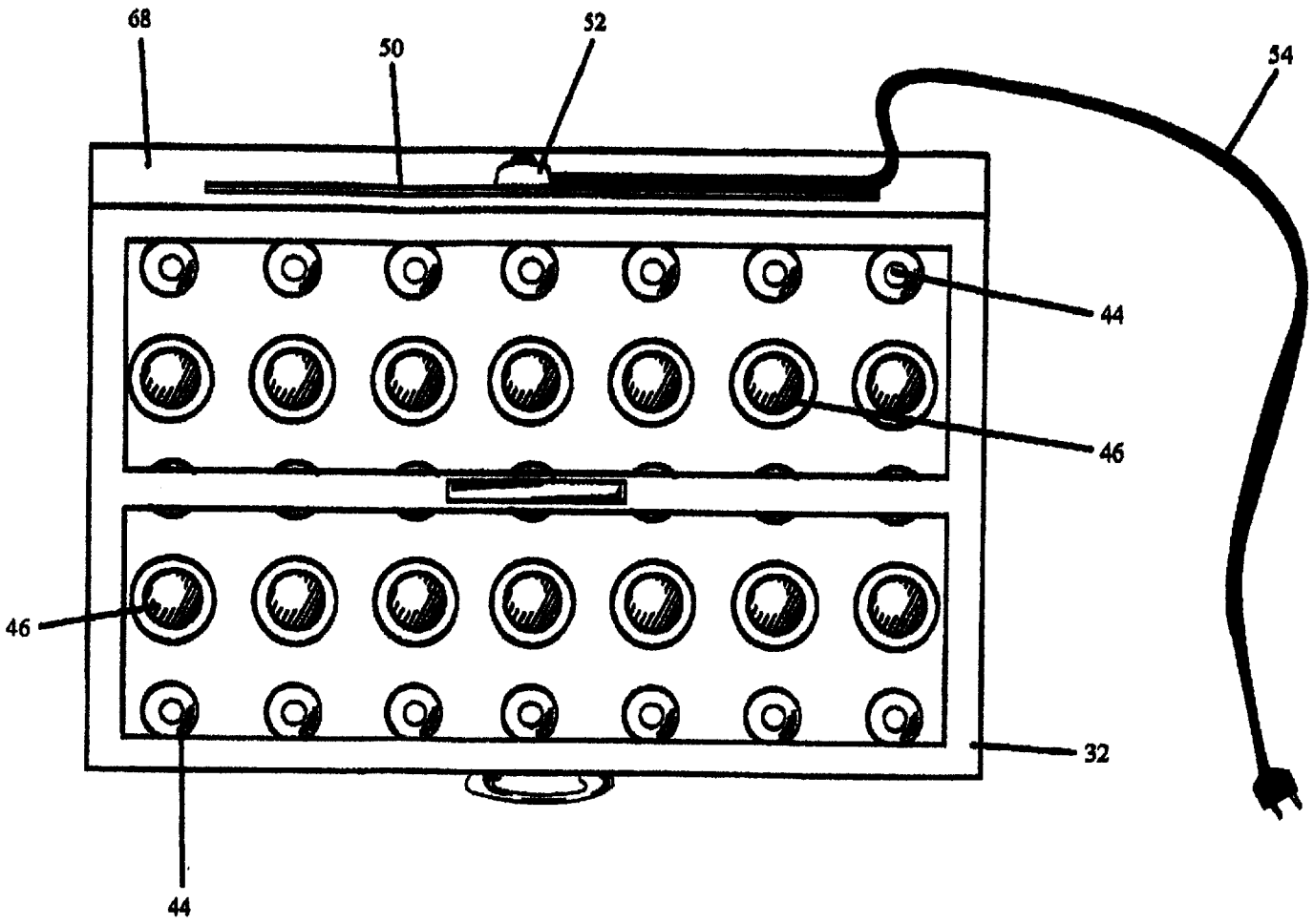
FIG. 4 is a top view of the tray without the top cover.

FIG. 4 is a top view of the tray 32 showing the nipple posts 44 and the ring/cap posts 46.

Although this invention has certain preferred embodiments, it will be obvious to those skilled in the art that various changes and modifications may be made therein without departing from the invention, and all such changes and modifications are intended to fall within the true spirit and scope of the invention.

What is claimed is:

1. A baby bottle dryer and organizer comprising:

a bottom panel;

a right side panel attached to the top of the bottom panel perpendicularly along the right edge of said bottom panel;

a left side panel attached to the top of the bottom panel perpendicularly along the left edge of said bottom panel;

a front panel having a plurality of apertures therein sized to fit bottles and jars therethrough, said front panel attached to the top of the bottom panel perpendicularly along the front edge of the bottom panel, said front panel attached along its right edge to the right panel, said front panel attached along its left edge to the left panel;

a top panel attached to the front panel and both side panels;

a partition having a plurality of apertures therethrough and also having a plurality of hollow posts attached thereto such that the hollow posts cover the apertures, each of said hollow posts having at least one aperture at the end thereof through which air can flow, said partition attached to the top of the bottom panel perpendicularly along the back edge of the bottom panel, said partition attached along its right edge to the right panel, said partition attached along its left edge to the left panel; and, a rear housing containing a blower mechanism attached to said partition.

2. The baby bottle dryer and organizer of claim 1 further comprising a front door hinged to the front edge of the bottom panel, said front door having a handle and means for holding said front door closed.

3. A baby bottle dryer and organizer comprising:

a bottom panel;

a right side panel attached to the top of the bottom panel perpendicularly along the right edge of said bottom panel, said right side panel having a horizontal lip protruding from the left side thereof;

a left side panel attached to the top of the bottom panel perpendicularly along the left edge of said bottom panel, said left side panel having a horizontal lip protruding from the right side thereof;

a front panel having a plurality of apertures therein sized to fit bottles and jars therethrough, said front panel attached to the top of the bottom panel perpendicularly along the front edge of the bottom panel, said front panel attached along its right edge to the right panel, said front panel attached along its left edge to the left panel;

a partition having a plurality of apertures therethrough and also having a plurality of hollow posts attached thereto such that the hollow posts cover the apertures, each of said hollow posts having at least one aperture at the end thereof through which air can flow, said partition attached to the top of the bottom panel perpendicularly along the back edge of the bottom panel, said partition attached alone its right edge to the right panel, said partition attached along its left edge to the left panel;

a rear housing containing a blower mechanism attached to said partition; and, a removable tray sitting upon the horizontal lip of the right side panel and the horizontal lip of the left side panel, said removable tray having an aperture facing said rear housing such that air can flow from the blower mechanism through said removable tray, said removable tray further having hollow posts thereupon, said hollow posts sized to hold baby bottle parts and having at least one aperture therein through which air can flow.

* * * * *